US008517778B2

(12) United States Patent
Fronius

(10) Patent No.: US 8,517,778 B2
(45) Date of Patent: Aug. 27, 2013

(54) CABLE TERMINAL HAVING A FIXING ELEMENT WITH A LOCKING TEETH ENGAGING A LOCKING EDGE TO PREVENT A RELEASE OF THE FIXING ELEMENT

(75) Inventor: Sven Fronius, Eppertshausen (DE)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/421,998

(22) Filed: Mar. 16, 2012

(65) Prior Publication Data

US 2012/0238157 A1 Sep. 20, 2012

(30) Foreign Application Priority Data

Mar. 18, 2011 (DE) ..... 10 2011 014 342

(51) Int. Cl.
*H01R 11/11* (2006.01)

(52) U.S. Cl.
USPC ..... 439/833

(58) Field of Classification Search
USPC ..... 439/883, 801, 813, 433, 434
See application file for complete search history.

(56) References Cited

U.S. PATENT DOCUMENTS

| | | | | |
|---|---|---|---|---|
| 1,697,954 | A | 1/1929 | Gribbie | |
| 1,874,593 | A | 8/1932 | Olson | |
| 3,190,333 | A | 6/1965 | Lanius, Jr. | |
| 3,340,494 | A | 9/1967 | Gutshall | |
| 3,993,397 | A | 11/1976 | Gutshall | |
| 4,905,122 | A * | 2/1990 | Culnan et al. | 361/673 |
| 5,183,419 | A * | 2/1993 | Dewar | 439/765 |
| 5,606,753 | A | 3/1997 | Hashimoto | |
| 6,227,782 | B1 | 5/2001 | Bowling et al. | |
| 6,280,263 | B1 | 8/2001 | Manor et al. | |
| 6,499,923 | B2 | 12/2002 | LeVey | |
| 7,056,162 | B2 | 6/2006 | Tournier et al. | |
| 7,070,461 | B1 | 7/2006 | Pavlovic et al. | |
| 7,819,707 | B2 * | 10/2010 | Aoki et al. | 439/801 |
| 8,303,357 | B2 * | 11/2012 | Kuwahara et al. | 439/883 |
| 2005/0136750 | A1 | 6/2005 | Tournier et al. | |

FOREIGN PATENT DOCUMENTS

| | | | |
|---|---|---|---|
| DE | 3624938 | A1 | 1/1988 |
| DE | 69105926 | T2 | 5/1995 |
| DE | 29806397 | U1 | 6/1998 |
| DE | 102006017436 | A1 | 11/2006 |
| DE | 602004005561 | T2 | 12/2007 |

OTHER PUBLICATIONS

German Patent Office, German Search Report for Application No. 102011014342.4, dated Feb. 7, 2012.

* cited by examiner

*Primary Examiner* — Chandrika Prasad
(74) *Attorney, Agent, or Firm* — Ingrassia Fisher & Lorenz, P.C.

(57) ABSTRACT

A cable terminal is provided for connecting an electric cable to a component of a motor vehicle. The cable terminal includes, but is not limited to a basic body with a connecting body and a transition piece. The connecting body is configured for an electrical connection to a cable. The transition piece includes, but is not limited to a rotatable fixing element at one end. The fixing element includes, but is not limited to a locking gear rim that is arranged on an outer jacket of the fixing element and locking teeth radially directed towards the outside interact with at least one locking edge of the transition piece and lock a releasing of the fixing element.

16 Claims, 6 Drawing Sheets

CABLE TERMINAL HAVING A FIXING ELEMENT WITH A LOCKING TEETH ENGAGING A LOCKING EDGE TO PREVENT A RELEASE OF THE FIXING ELEMENT

CROSS-REFERENCE TO RELATED APPLICATION

This application claims priority to German Patent Application No. 10 2011 014 342.4, filed Mar. 18, 2011, which is incorporated herein by reference in its entirety.

TECHNICAL FIELD

The technical field relates to a cable terminal for connecting an electric cable to a component of a motor vehicle, the cable terminal comprises a basic body with a connecting body and a transition piece, the connecting body is configured for an electrical connection with the power cable, and the transition piece comprises a rotatable fixing element at one end.

BACKGROUND

In this regard, an electrical connection is known from the publication DE 10 2006 017 436 A1. For connecting a conductor to a component, the electrical connection comprises a connecting body which is configured for an electrical connection with the conductor. The connecting body comprises a first part and at least a protrusion, which extends from the first part. The connection furthermore comprises a fastening element, which is associated with the connecting body in order to connect the connecting body to the component.

The at least one protrusion can be connected to the component and is configured in order to remove non-conductive coatings from the component when the connecting body is connected to the component. Although such a protrusion can remove coatings from the component when the connecting body is connected to the component, this protrusion, however, is not able to securely lock a loosening of the fastening element, more so since the at least one protrusion only makes possible a frictional connection when fixing the fastening element.

In view of the foregoing, at least one object is to improve a cable terminal for connecting an electric cable to a component of a motor vehicle and more reliably lock a loosening of the connection. In addition, other objects, desirable features, and characteristics will become apparent from the subsequent summary and detailed description, and the appended claims, taken in conjunction with the accompanying drawings and this background.

SUMMARY

An embodiment of a cable terminal is provided for connecting an electric cable to a component of a motor vehicle. The cable terminal comprises a basic body with a connecting body and a transition piece. The connecting body is designed for an electrical connection with a cable. The transition piece comprises a rotatable fixing element at one end. The fixing element comprises a locking gear rim, which is arranged on an outer jacket of the fixing element. Locking teeth radially directed to the outside interact with at least one locking edge of the transition piece and lock a loosening of the fixing element.

The cable terminal has the advantage that the locking gear rim radially acting towards the outside opposes the locking of the rotatably arranged fixing element during the attaching of the cable terminal to the component of the vehicle with a relatively low torque resistance and through the interacting of the locking edge of the transition piece with the locking teeth of the locking gear rim makes possible a multiplicity of locking positions, which merely depends on the number of the locking teeth of the locking gear rim distributed over the outer jacket.

In addition, a freewheel of the locking gear rim is provided so that an engaging of the locking teeth of the locking gear rim radially directed towards the outside occurs on the locking edge and thus a torque resistance occurs only during the last rotations of the rotatable fixing element upon the contacting of the transition piece of the basic body of the cable terminal with the component of the vehicle to be connected. Thus, this cable terminal has the advantage compared with conventional cable terminals, which have self-locking fixing elements that manufacturing times in the production can be saved because of a possible higher rotational speed of the screwdrivers, more so since ratchet resistances of the locking rim gear occur only during the last revolutions.

In addition, an increase of the process security during the screwing or connecting of the cable terminal to a component of the vehicle is obtained. Furthermore, the assembly costs and the material costs become more favorable, since additional lubrication of the fixed fixing device on the component of the vehicle can be omitted. Such lubrication and such lubricants are required with convention self-locking fixing elements in order to reduce the torque resistance of the self-locking fixing device during the fixing to the component of the vehicle.

In addition, crimping and thus damaging of a rotatable fixing device on the cable terminal and of a fixed fixing device on the component after the fixing so that no damaging of the fixing device is required. When fixing the cable terminal, no limitation of the rotational speed of a screwdriver is required in principle. In contrast, the maximum rotational speed of the screwing usually has to be limited to approximately 300 rpm with conventional self-locking fixing elements of the cable terminal in order to avoid increased heat development and increased risk of damaging of the inter-engaging fixing elements of cable terminal and component of the vehicle.

In a further embodiment, the fixing element comprises a ring-shaped collar the rotatably protrudes into openings of lateral holding bows of the transition piece. The holding bows thus form a mounting for the rotatable fixing element, in that they partially enclose the ring-shaped collar.

It is provided, furthermore, that the locking gear rim can be radially arranged on the ring-shaped collar and at least one locking edge is arranged on each holding bow. This has the advantage that collar and locking gear rim are mounted by the holding bows and the holding bows simultaneously comprise an abutment in the form of locking edges for the locking gear rim. To this end, the edges are beveled in the direction of the top of the transition piece to the locking edges and have an inclined surface which increasingly exerts a ratchet resistance on the locking gear rim when tightening the fixing element. Because of the equal-sided locking teeth of the locking gear rim the locking effect of the locking teeth is the same in both directions, so that with the same force or torque effort as during tightening, a loosening of the fixing of the cable terminal is possible. For this purpose, the four edges of the two holding bows that can be brought into engagement with the locking gear rim are equipped with bevels acting in opposition to each other.

Furthermore, it is provided that the transition piece can have an angled-off portion that can form a right angle to the connecting body so that the connecting body is arranged at a right angle to the fixing element. Thus, it is achieved that the axis of the fixing element is oriented parallel to the cable axis of the cable end fixed in the connecting body. Thus, the access to the fixing element by suitable electric screwdrivers is facilitated and the cable terminal size reduced at the same time since compared with a straight-line basic body, which has no angled-off portion, a suitable spacing for screw sockets of the screwdrivers for example have to be provided between the fixing element and the cable end or the connecting body. Through the angled-off portion this spacing can be reduced since the end of the cable no longer obstructs a screwdriver tool. Through the provided angled-off portion, the cable terminal can also be adapted to the outer contour of the component to be connected.

In a further embodiment it is provided that the fixing element comprises a multiple-edge nut or a multiple-edge screw. The decision between nut or screw solely depends on which fixed fixing element is provided on the component for connecting the cable terminal to the component. If the fixed fixing element on the component has an internal thread, a multiple-edge screw can be provided as rotatable fixing element on the cable terminal If the fixed fixing element on the component comprises a threaded pin, it is advantageous if the rotatable fixing element on the cable terminal is a multiple-edge nut. In both cases it is provided that the fixing element of the cable terminal protrudes over the holding bows of the transition piece in order to facilitate the starting of a screwdriver and simultaneously reduce the radial extension of the locking gear rim and thus the width of the basic body of the cable terminal It is provided, furthermore, that the connecting body comprises straps having a force fit on wire ends of the cable, and has further straps which can have a force fit on a cable sheath of the cable. Here, the straps, the connecting body, the transition piece and the holding bows of the transition piece are designed in such a manner that the basic body of the cable terminal can be punched and form-pressed out of a metal sheet with a single tool.

The cable terminal can be employed for connecting a power cable to an electrical consumer, a generator, an energy storage device or a starter motor of a motor vehicle. It is also possible, furthermore, to employ the cable terminal for signal lines between corresponding control devices of the vehicle with suitable minimization of its dimensions.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
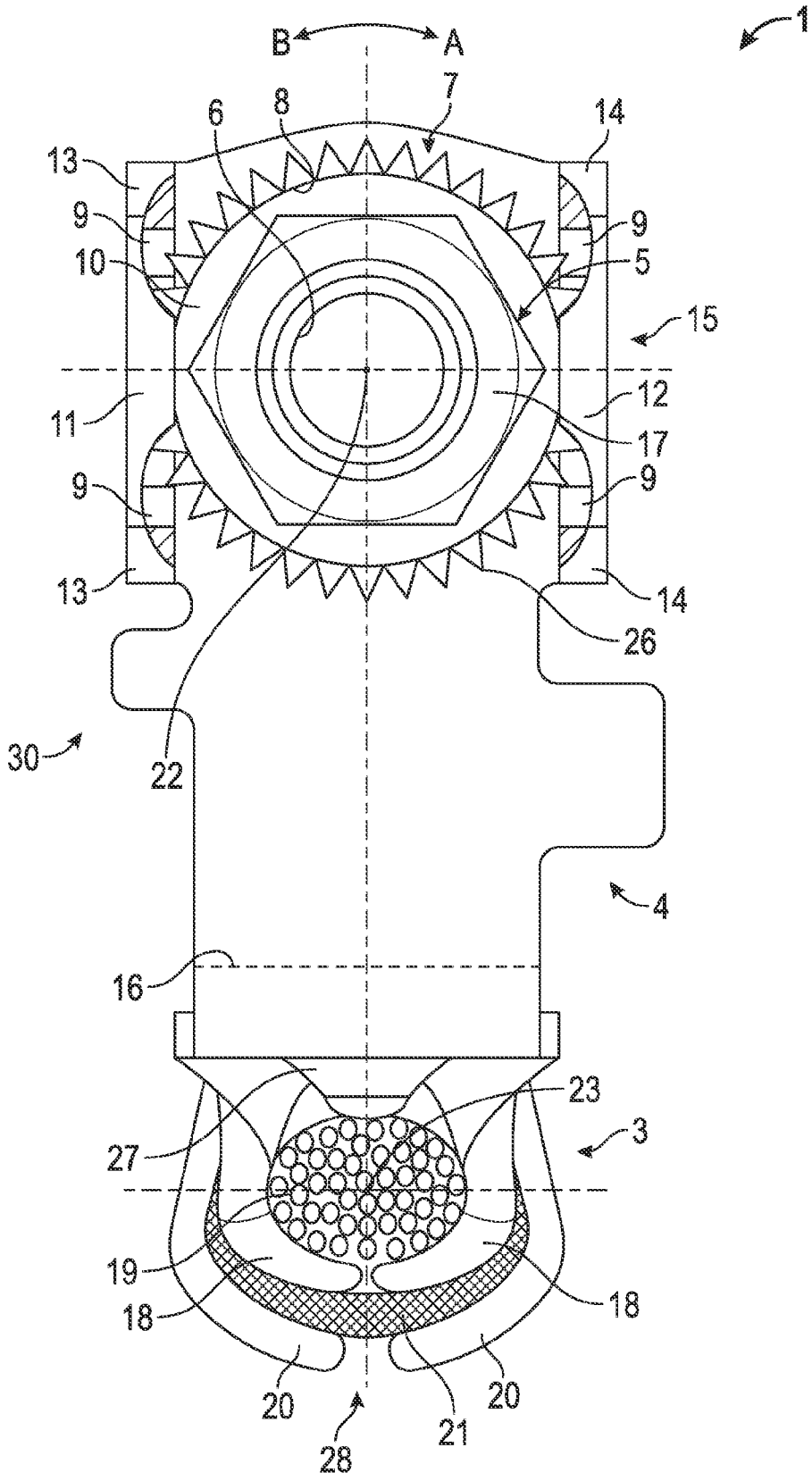
FIG. 1 shows a schematic top view of a cable terminal of a first embodiment.

FIG. 1 shows a schematic top view of a cable terminal 1 of a first embodiment. The cable terminal 1 comprises a basic body 30 of a punched, form-pressed sheet metal strip. The basic body 30 comprises a connecting body 3, which presses together a cable end 28 with wire ends 19 and an end of a cable sheath 21, and comprises a transition piece 4 following the connecting body 3. This transition piece 4 is angled-off through an angled-off portion 16 relative to the connecting body 3. On the leg of the angled-off portion 16 a fixing element 5 is rotatably arranged on an end 15 of the transition piece 4. The fixing element 5 in this embodiment comprises a hexagon nut 17 with a threaded bore 6. Through the angled-off portion 16 an axis 22 of the threaded bore 6 runs parallel to an axis 23 of the cable end 28.

The wire ends 19 of the cable end 28 are pressed against an abutment 27 through straps 18 of the connecting body 3. Further straps 20 fix the cable sheath 21 of the cable in the region of the cable end 28 to the connecting body 3. The hexagon nut 17 employed as fixing element 5 has a collar 10, which is surrounded by a locking gear rim 7 radially on the outside on an outer jacket 8 of the collar 10. The collar 10 with the locking gear rim 7 arranged radially outside is fixed to the hexagon nut 17 and rotates with the latter when the hexagon nut 17 is screwed onto a suitably fixed fixing element of a component of the vehicle.

To this end, the hexagon nut 17 with its collar 10 and the locking gear rim 7 is rotatably mounted on the end 15 of the transition piece 4, wherein lateral regions of the transition piece 4 are folded into holding bows 13 and 14 and comprise openings 11 and 12, in which the collar 10 with the locking gear rim 7 is rotatably mounted. On each of the two holding bows 13 and 14, at least one locking edge 9 is arranged, which without major torque resistance makes possible a rotating of the hexagon nut 17 in fixing direction A and locks a rotating in rotating direction B for releasing a connection between the cable terminal 1 and a component.

The openings 11 and 12 have a larger width than the thickness of the collar 10 with the locking gear rim 7, so that it is possible without a ratchet resistance to screw the hexagon nut 17 in direction of rotation A onto a fixed fixing element or a cylindrical pin of the component of a vehicle beyond the otherwise usual maximum rotational speed of 300 rpm. Only when the rotatable fixing element 5 with its locking gear rim reaches the locking edges 9 of the holding bows 13 and 14 does a ratchet resistance of the locking teeth 26 of the locking gear rim 7 has to be overcome with last rotations.

Figure 2:
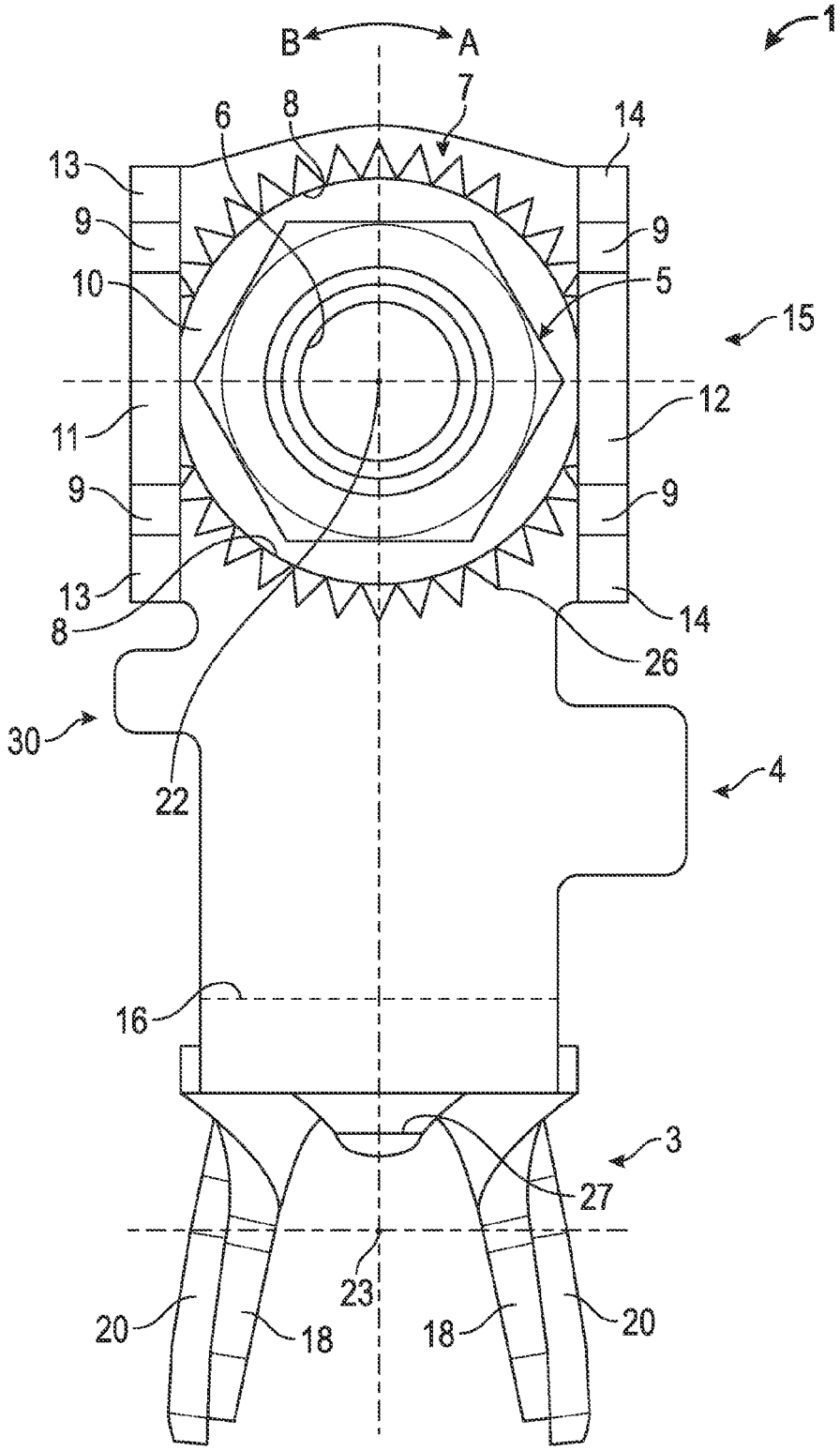
FIG. 2 shows the top view of the cable terminal according to FIG. 1 prior to assembling a cable end to the connecting body of the basic body of the cable terminal.

FIG. 2 shows a top view of the cable terminal 1 according to FIG. 1 prior to assembling a cable end to the connecting body 3 of the body 3 of the cable terminal 1. Components with the same functions as in FIG. 1 are marked with the same reference characters in the following Figures and are not separately explained. To this end, the straps 20 for a sheath of a cable end of the cable are spread apart and stand ready for being bent onto a cable end. Accordingly, straps 18 also stand ready spread apart for wire ends of the cable, wherein the spreading distance of the straps 18 for the wire ends is smaller than the spreading distance of the straps 20 for the cable sheath. Furthermore, the connecting body 3 comprises an abutment 27 above the straps 18 and 20 and below the angled-off portion 16 of the transition piece 4. On bending over of the spread straps 18, the wire ends are pressed against the abutment 27 and deformed. The abutment can also be formed as a sleeve in which the wire ends can be crimped together.

Figure 3:
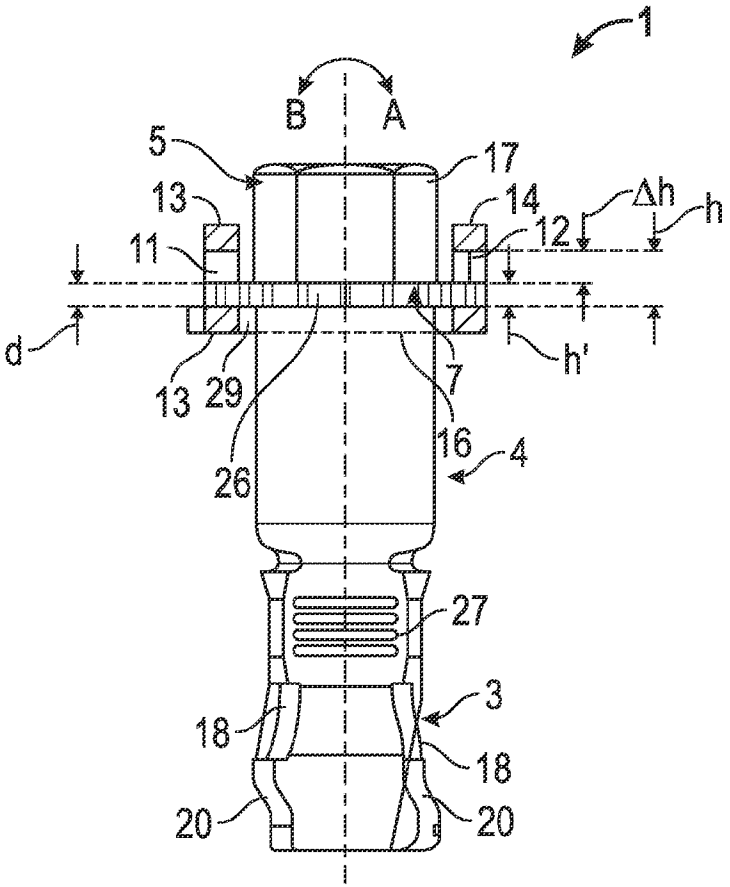
FIG. 3 shows a schematic first lateral view of the cable terminal according to FIG. 2.

FIG. 3 shows a schematic first lateral view of the cable terminal 1 according to FIG. 2. The view according to FIG. 3 initially shows in the lower region the connecting body 3 with the straps 18 for the wire ends and the straps 20 for the end of the cable sheath. In addition, FIG. 3 shows the abutment 27 of the connecting body 3, which in its shape is modified for receiving wire ends. This is followed by the transition piece 4 with the angled-off portion 16, so that the transition piece 4 now has a horizontal leg 29 whose lateral edges are folded into holding bows 13 and 14 and form openings 11 and 12, in which the collar with the locking teeth 26 of the locking gear rim 7 arranged on the outside is rotatably mounted.

The holding bows 13 and 14 comprise locking edges, which merely have a height h', which correspond to the thickness d of the collar and of the locking gear rim 7 and are beveled. In addition to this, the openings 11 and 12 have an additional height difference Δh, which makes it possible that the hexagon nut 17 with the collar and the radially outer locking gear rim 7 can be rotated there in an unrestricted manner above the locking edges 9 in both directions of rotation A and B with rotational speeds above 300 rpm.

Figure 4:
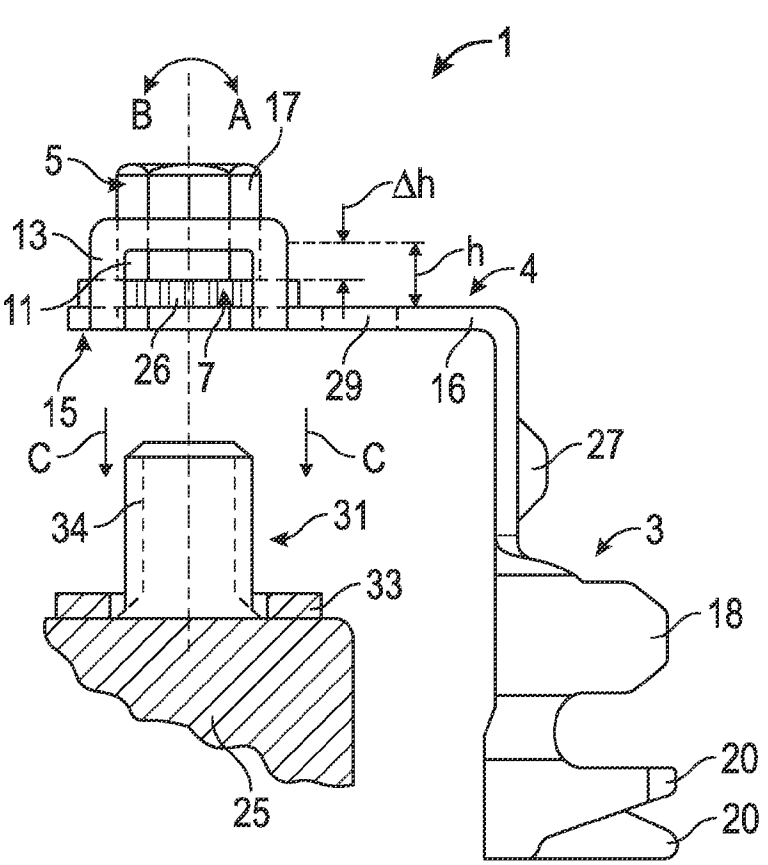
FIG. 4 shows a second lateral view of the cable terminal according to FIG. 2 that is at a right angle to the first lateral view.

FIG. 4 shows a second lateral view of the cable terminal 1 according to FIG. 2 that is arranged at a right angle to the first lateral view. In addition, a part region of a component 25 of a motor vehicle is visible with a fixed fixing element 31, which comprises a threaded pin 34, which is surrounded by a washer 33. This threaded pin 34 can be brought into engagement with the hexagon nut 17 when fitting the cable terminal 1, wherein the hexagon nut 17 is lifted in the holding bow 13 with the locking gear rim 7, so that the locking gear rim 7 is no longer in engagement with the locking edges of the holding bow 13 and the hexagon nut 17 can be screwed onto the fixed fixing element 31 of the component 25 of the motor vehicle, which is formed as a threaded pin 34, in an unrestricted manner.

Figure 5:
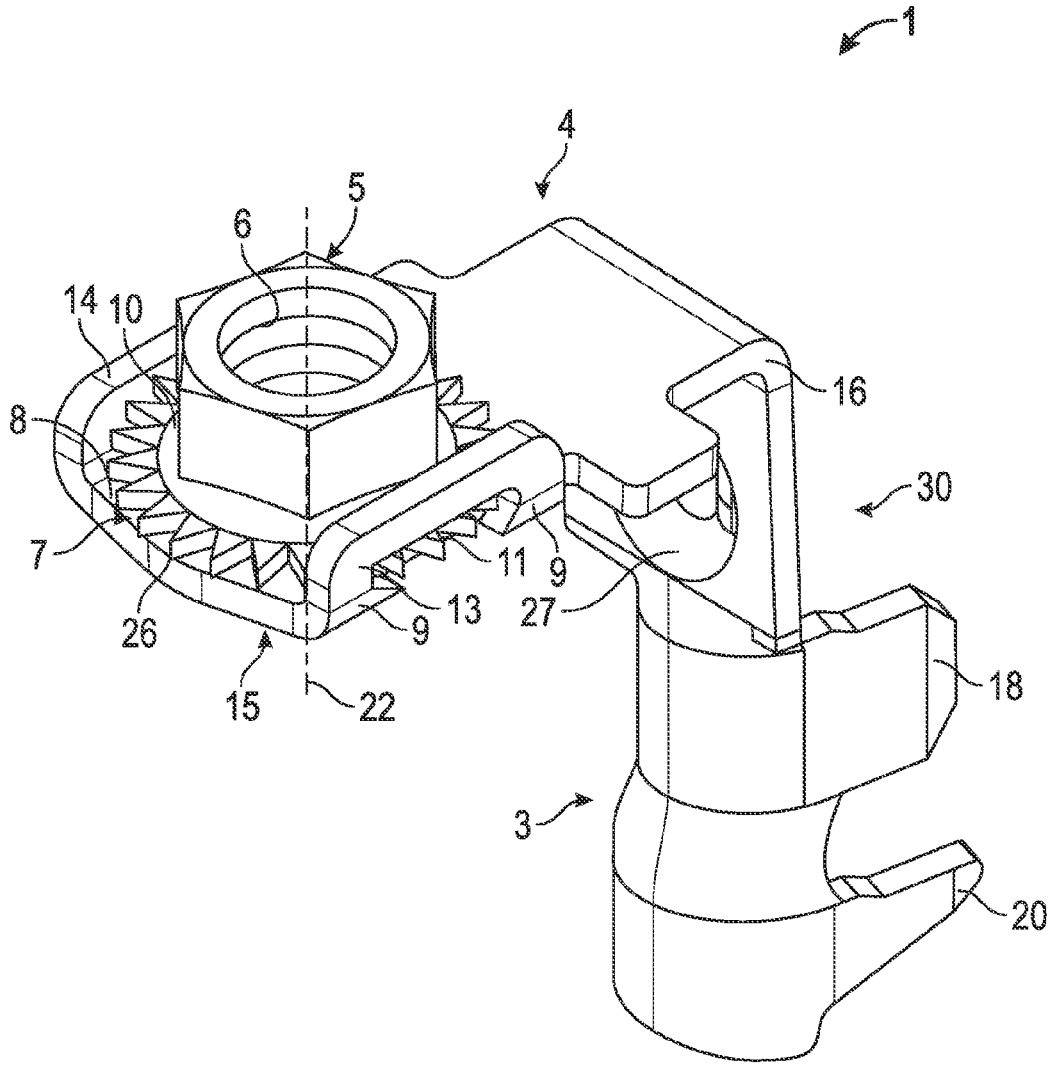
FIG. 5 shows a schematic perspective view of the cable terminal according to FIG. 2.

FIG. 5 shows a schematic perspective view of the cable terminal 1 according to FIG. 2 prior to the connecting of a cable end with wire ends to the connecting body 3 with its abutment 27. In addition it becomes clear that the basic body 30 can be produced from a sheet metal strip with the help of a single punching and press-forming step. FIG. 5 additionally allows a view of the beveled locking edges 9 of the holding bow 13, the inclines of which are oriented so that both during the tightening and also during the releasing the engagement of the locking gear rim 7 on the locking edges 9 has to be overcome. Since the locking teeth 26 of the locking gear rim are equal-sided and the inclines of the locking edges of a holding bow 13 are embodied in opposing directions but equiangular, ratchet resistances that are almost identical in magnitude have to be advantageously overcome for tightening and for releasing of the fixing element.

Figure 6:
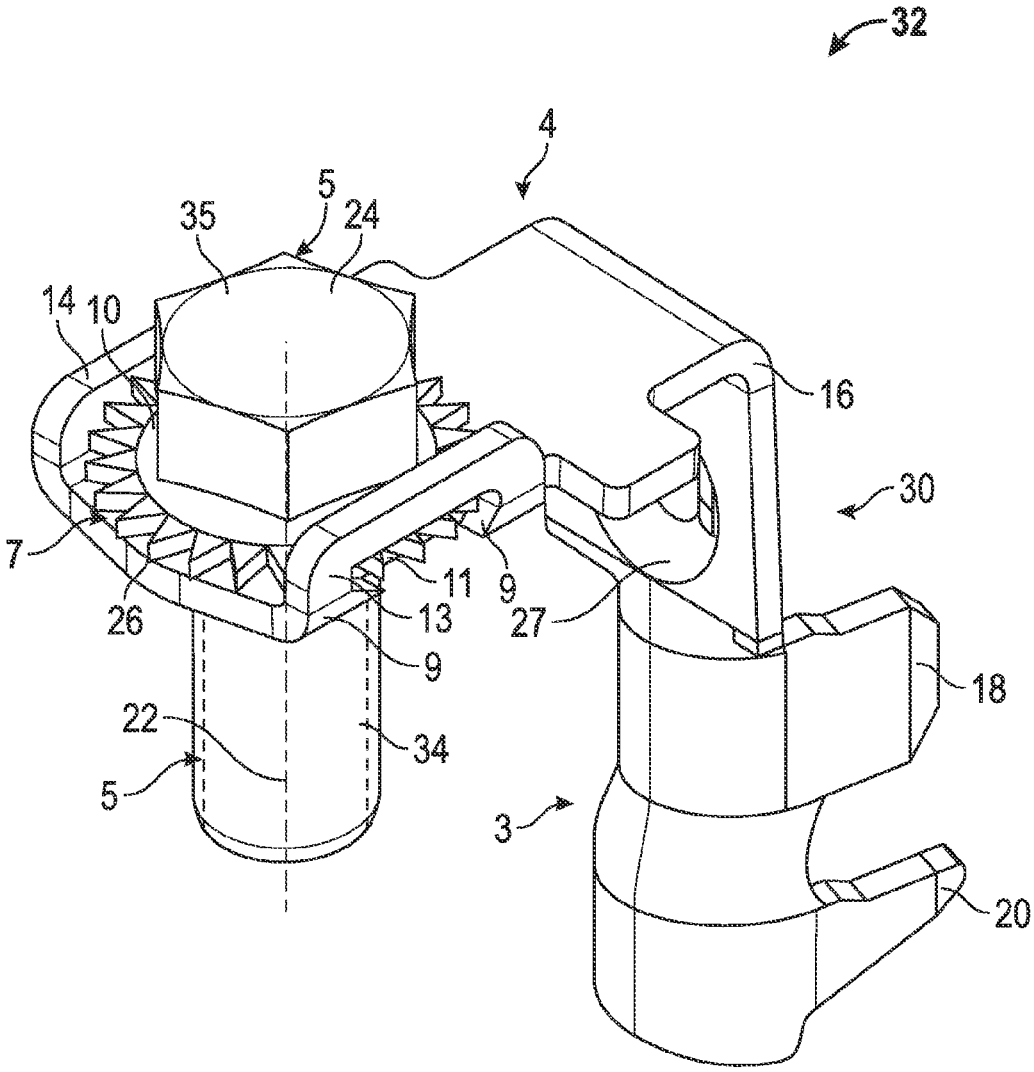
FIG. 6 shows a schematic perspective view of a cable terminal according to a second embodiment.

FIG. 6 shows a schematic perspective view of a cable terminal 32 according to a second embodiment. This second embodiment differs from the first embodiment shown in FIG. 5 in that instead of a hexagon nut a hexagon screw 24 is now held and rotatably mounted by the holding bows 13 and 14 of the transition piece 4, wherein a screw head 35 in the transition region to the threaded pin 34 comprises the collar 10 with the radially outer locking gear rim 7, which is held, mounted and locked against releasing of the hexagon screw 24 by locking edges 9 on the holding bows 13 and 14 in the openings 11 and 12 as shown in FIG. 3.

Figure 7:
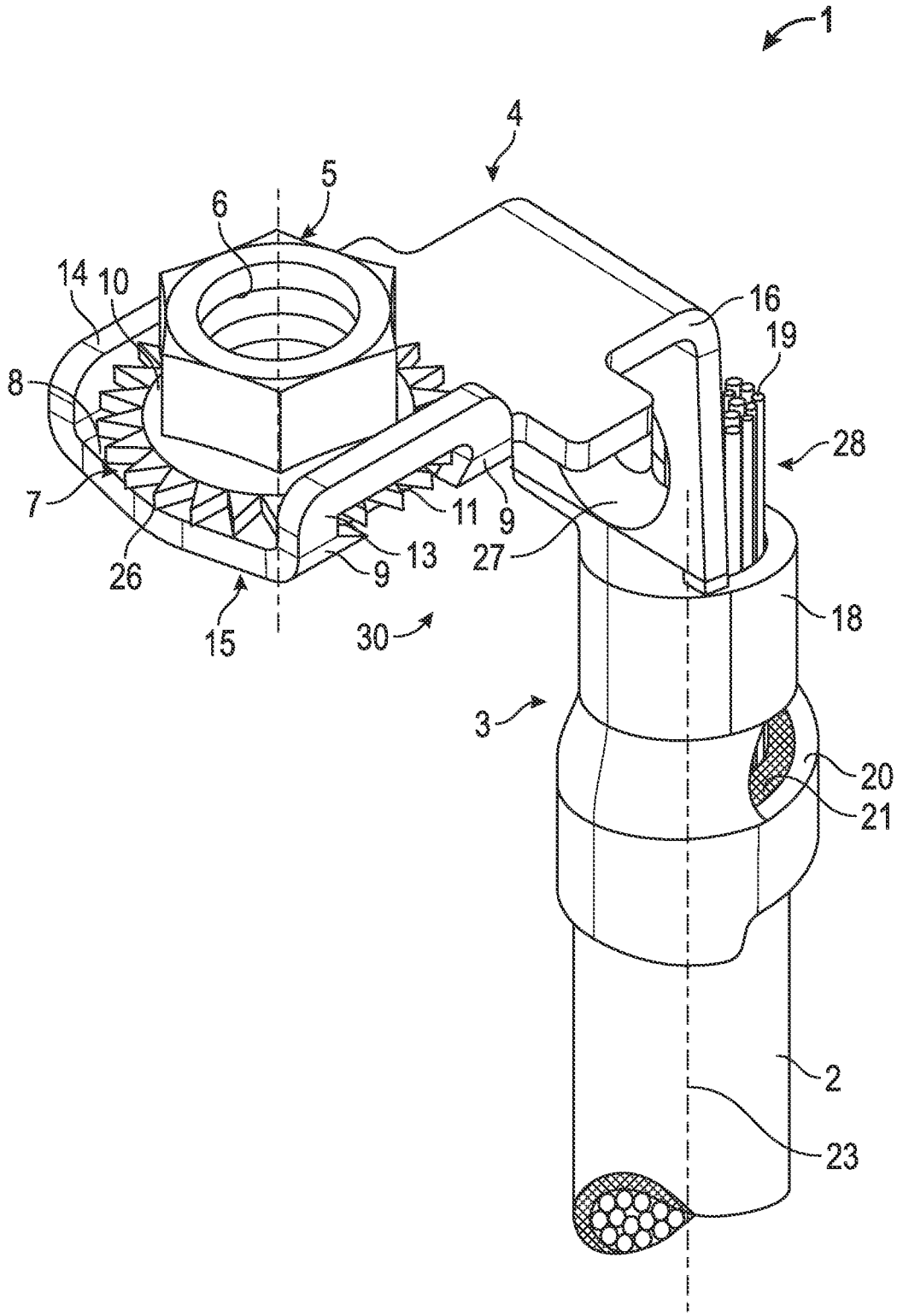
FIG. 7 shows a schematic perspective view of a cable terminal according to FIG. 1.

FIG. 7 shows a schematic perspective view of a cable terminal 1 according to FIG. 1 with an electric cable 2, the sheath of which is held by straps 20 of the connecting body 3 and the wire ends 19 of which are pressed and deformed by the straps 18 of the connecting body 3. In the process, the wire ends 19 are pressed against the abutment 27 and deformed, so that after the crimping of the straps 18 onto the wire ends 19 an intensive electrical contact between the wire ends 19 and the basic body 30 of the cable terminal 1 is ensured.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A cable terminal for connecting an electric cable to a component of a motor vehicle, comprising:

a basic body comprising a transition piece and a connecting body that is configured for an electrical connection to the electric cable;

a fixing element that is configured to fix the cable terminal to the component and rotatably arranged at an end of the transition piece;

a locking gear rim that is arranged on an outer jacket of the fixing element; and locking teeth radially directed to the outside that is configured to interact with a locking edge of the transition piece and lock a releasing of the fixing element.

2. The cable terminal according to claim 1, wherein the fixing element comprises a ring-shaped collar that rotatably protrudes into openings of lateral holding bows of the transition piece.

3. The cable terminal according to claim 2, wherein the lateral holding bows are configured to form folded legs at the end of the transition piece and abutments for the ring-shaped collar.

4. The cable terminal according to claim 3, wherein the locking gear rim is radially arranged on the ring-shaped collar and the locking edge is arranged on each holding bow.

5. The cable terminal according to claim 1, wherein the transition piece comprises an angled-off portion and the connecting body is arranged at a right angle to the fixing element.

6. The cable terminal according to claim 1, wherein an fixing axis of the fixing element is arranged parallel to a clamped axis of a clamped-in cable.

7. The cable terminal according to claim 1, wherein the fixing element is a multiple-edge nut.

8. The cable terminal according to claim 1, wherein the fixing element is a multiple-edge screw.

9. The cable terminal according to claim 8, wherein the fixing element is configured to protrude over holding bows of the transition piece.

10. The cable terminal according to claim 8, wherein the locking gear rim is configured to interact with lateral locking edges of holding bows such that the fixing element is released for the tightening and locked for a releasing.

11. The cable terminal according to claim 1, wherein the connecting body comprises straps that have a force fit on wire ends of the electric cable.

12. The cable terminal according to claim 1, wherein the connecting body comprises straps that have a force fit on a cable sheath of the electric cable.

13. The cable terminal according to claim 1, wherein the cable terminal connects a power cable to an electrical consumer of the motor vehicle.

14. The cable terminal according to claim 1, wherein the cable terminal connects a power cable to an electric generator of the motor vehicle.

15. The cable terminal according to claim 1, wherein the cable terminal connects a power cable to an electric energy storage unit of the motor vehicle.

16. The cable terminal according to claim 1, wherein the cable terminal connects a power cable to an electric starter motor of the motor vehicle.

* * * * *